United States Patent [19]

Nadkarni et al.

[11] 4,408,999

[45] Oct. 11, 1983

[54] COAL AND OIL SHALE BENEFICIATION PROCESS

[75] Inventors: Ramachandra A. Nadkarni; Rollie B. Williams, both of Baytown, Tex.

[73] Assignee: Exxon Research and Engineering Co., Florham Park, N.J.

[21] Appl. No.: 262,146

[22] Filed: May 11, 1981

[51] Int. Cl.[3] ..... C10L 9/02; C10G 1/04

[52] U.S. Cl. ..... 44/1 SR; 208/11 LE; 208/252

[58] Field of Search ..... 44/1 SR, 1 B; 201/17; 208/11 LE, 252

[56] References Cited

U.S. PATENT DOCUMENTS

| | | | |
|---|---|---|---|
| 200,633 | 2/1878 | Morey | 44/1 SR |
| 3,993,455 | 11/1976 | Reggel et al. | 44/1 SR |
| 4,076,607 | 2/1978 | Zavitsanos et al. | 44/1 SR |
| 4,083,940 | 4/1978 | Das | 44/1 SR |
| 4,134,737 | 1/1979 | Yang | 44/1 SR |
| 4,148,614 | 4/1979 | Kirkbride | 44/1 SR |
| 4,152,120 | 5/1979 | Zavitsanos et al. | 44/1 SR |
| 4,153,533 | 5/1979 | Kirkbride | 208/11 R |
| 4,169,710 | 10/1979 | Jensen | 44/1 SR |

FOREIGN PATENT DOCUMENTS

| | | | |
|---|---|---|---|
| 917103 | 12/1972 | Canada | 208/11 LE |
| 1567129 | 5/1980 | United Kingdom . | |

OTHER PUBLICATIONS

Barrett, P., Davidowsky, Jr., L. J., Penaro, K. W., and Copeland, T. R., "Microwave Oven-Based Wet Digestion Technique", *Analytical Chemistry,* vol. 50, No. 7, Jun. 1978.

Abu-Samra, A., Morris, J. S., and Koirtyohann, S. R., "Wet Ashing of Some Biological Samples in a Microwave Oven", *Analytical Chemistry,* vol. 47, No. 8, Jul. 1975.

*Primary Examiner*—Carl F. Dees

*Attorney, Agent, or Firm*—Yale S. Finkle

[57] ABSTRACT

Coal, oil shale and similar carbonaceous solids are beneficiated by subjecting the solids to electromagnetic radiation having a frequency between about 0.1 MHz and about $10^5$ MHz in the presence of an aqueous acid solution. The electromagnetic energy enables the acid to solubilize a substantial portion of the mineral matter contained in the solids at low temperatures and pressures, thereby producing beneficiated carbonaceous solids containing relatively small amounts of inorganic constituents.

11 Claims, 1 Drawing Figure

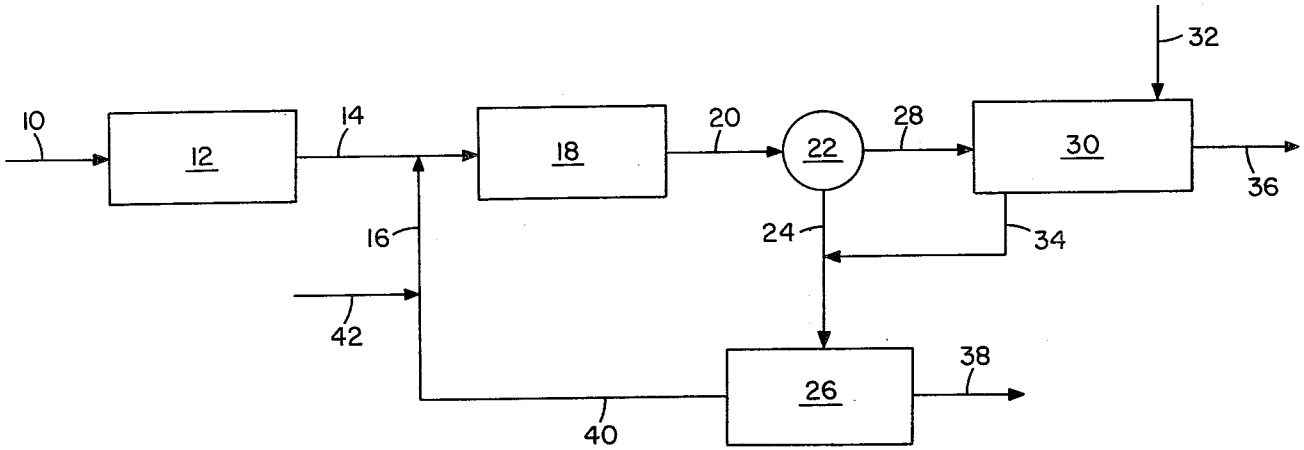
10
12
14
16
18
20
22
24
26
28
30
32
34
36
38
40
42

COAL AND OIL SHALE BENEFICIATION PROCESS

BACKGROUND OF THE INVENTION

This invention relates to a process for beneficiating coal, oil shale and similar carbonaceous solids that contain impurities in the form of inorganic sulfur and other ash-forming, inorganic constituents commonly referred to as mineral matter, and is particularly concerned with upgrading raw coal and oil shale by removing a substantial portion of these inorganic constituents.

Raw coal contains impurities in the form of inorganic, rock-like constituents which include, among other inorganic compounds, aluminosilicates, metal oxides, iron pyrites, other metal pyrites and small amounts of metal sulfates. Before coals or similar carbonaceous solids containing such inorganic impurities are used as fuel or as a feed to a conversion process, it is desirable to remove as much of the inorganic constituents as possible so that when the solids are burned or otherwise utilized they will have a relatively high BTU content, will generate relatively small amounts of sulfur-containing pollutants such as sulfur dioxide and hydrogen sulfide, and will leave relatively small amounts of unwanted ash and mineral residues.

Numerous physical and chemical processes have been proposed in the past for the improved beneficiation of coal and similar carbonaceous solids by either removing the mineral matter or sulfur. The physical methods normally involve crushing the coal to a relatively small size, subjecting the crushed coal to a gravimetric separation and recovering the low density material from the gravimetric separation as the beneficiated coal. The problem with this physical method is that only a portion of the inorganic materials is removed and therefore the low density fraction that is recovered still contains a significant amount of mineral matter. Many chemical treatments have been proposed for coal and similar carbonaceous material; however, these methods are all expensive and a large number of the proposed processes are only effective in removing sulfur. Since the above-mentioned conventional and proposed processes are either expensive or only remove a small portion of the mineral matter present, none of them appear to be a likely candidate for commercialization.

SUMMARY OF THE INVENTION

The present invention provides a process for the beneficiation of coal, oil shale and similar carbonaceous solids containing inorganic, ash-forming constituents which at least in part alleviates the difficulties described above. In accordance with the invention it has now been found that increased amounts of mineral matter, impurities in the form of inorganic, ash-forming constituents including inorganic sulfur compounds, can be effectively removed from bituminous coal, subbituminous coal, lignite, oil shale, and similar carbonaceous solids which contain such mineral matter by forming a slurry of said carbonaceous solids in an aqueous inorganic acid, treating the slurry with electromagnetic radiation having a frequency between about 0.1 MHz and about $10^5$ MHz, and recovering carbonaceous solids depleted in inorganic constituents from the treatment step. Normally, the carbonaceous solids to be treated will be crushed to a size below a value in the range between about 8 mesh and about 200 mesh on the U.S. Sieve Series Scale and mixed with an aqueous inorganic acid solution to form the slurry which is subjected to the electromagnetic energy. The electromagnetic energy evidently facilitates the reaction of the acid with the inorganic constituents in the carbonaceous solids thereby promoting their solubilization at relatively mild temperatures. The slurry is normally subjected to the electromagnetic energy at ambient conditions for a short period of time in order to remove a substantial amount of the inorganic constituents including inorganic sulfur. The beneficiated carbonaceous solids recovered from the treatment step will contain a relatively high amount of organic constituents and a relatively low amount of inorganic constituents and are suitable for use as feed material to combustion, liquefaction, gasification, pyrolysis, and similar conversion processes.

The process of the invention provides a method for the chemical beneficiation of coal, oil shale and similar carbonaceous solids which results in the removal of greater amounts of inorganic constituents from the raw solids than is normally possible by utilizing conventional upgrading techniques. Furthermore, the process is effective in removing greater amounts of inorganic constituents under milder conditions than is possible with many chemical beneficiation processes that have been proposed in the past. Thus the process of the invention can be used to provide a ready market for coals, oil shales and other carbonaceous solids which could not otherwise be efficiently processed because of high sulfur and mineral matter content, thereby alleviating, to some extent, the ever-increasing demand for the Country's dwindling supplies of oil and gas.

BRIEF DESCRIPTION OF THE DRAWING

The drawing is a schematic flow diagram of a beneficiation process carried out in accordance with the invention.

DESCRIPTION OF THE PREFERRED EMBODIMENTS

The process depicted in the drawing is one for the chemical beneficiation of bituminous coal, subbituminous coal, lignite, oil shale and similar carbonaceous solids which contain inorganic, ash-forming constituents. It will be understood that the feed to the beneficiation process is not restricted to coal or oil shale and instead can be any solid carbonaceous material containing inorganic constituents. The feed can be, for example, charcoal, organic wastes, petroleum coke, char, gasification residues, liquefaction residues, pyrolysis residues, and the like. Preferably, the solid feed material will be somewhat porous in order to allow penetration by the aqueous inorganic acid.

In the process depicted in the drawing, the solid carbonaceous feed material is passed through line 10 into rotary crusher or similar fragmenting device 12 where the particles are ground, crushed or otherwise reduced in size to form smaller particles. The amount of inorganic constituents that is removed from the crushed solids in the process will depend upon the size of the particles fed to the electromagnetic radiation treatment step. Normally, the smaller the particles, the greater is the removal of inorganic constituents. It is, however, undesirable to crush or grind to very small particle sizes since this requires a relatively large input of energy and makes the subsequent separation steps difficult to achieve. The actual size of the particles produced in the rotary crusher is determined in part by balancing the cost of crushing with the amount of inorganic constituents that is liberated in the electromagnetic radiation treatment step and the fineness of the resultant product. In general, crusher 12 will be operated to produce particles having a size below a value in the range from about 8 mesh to about 200 mesh on the U.S. Sieve Series Scale, preferably below a value in the range from about 40 mesh to about 100 mesh. Normally, the size of the solids exiting the crusher can be increased as the porosity of the carbonaceous feed solids is increased.

The crushed solids removed from rotary crusher 12 through line 14 are mixed with an aqueous inorganic acid solution introduced into line 14 via line 16 and the resultant slurry is passed into electromagnetic irradiation zone 18. In general, any inorganic acid can be used in the process of the invention. Normally, the inorganic acid will be a strong acid such as hydrochloric acid, sulfuric acid, hydrofluoric acid, or nitric acid. Some of these acids will have a tendency to dissolve certain inorganic constituents preferentially to others and the actual acid used may depend upon the inorganic content of the carbonaceous material which is fed to the process. For example, hydrofluoric acid would be used when it is desired to remove silica. Hydrochloric acid or sulfuric acid alone may be used when it is desired to remove substantial portions of sulfur and other inorganic constituents. In general, the use of nitric acid is less desirable since it tends to oxidize the carbonaceous material. In some cases it may be preferable to use a mixture of acids in order to obtain complete solubilization of the inorganic constituents. A combination of hydrochloric acid, nitric acid and hydrofluoric acid has been found to be a particularly effective mixture of acids. In general, it is preferable to use the acids in their strongest concentrations; however, in some cases more dilute aqueous solutions of the acids may be used. Normally, sufficient acid or mixture of acids is introduced into line 14 to effect near complete solubilization of the mineral matter. The actual amount of acid solution utilized is not critical as long as there is a sufficient amount present to retain the dissolved mineral matter in solution.

The slurry of crushed carbonaceous solids and aqueous inorganic acid is passed into electromagnetic irradiation zone 18 where it is treated with electromagnetic radiation having frequencies in the radio wave or the microwave range. Normally, the slurry is fed into the irradiation zone at ambient conditions—atmospheric pressure and ambient temperature. It has been found, however, that preheating the slurry prior to its introduction into the electromagnetic irradiation zone will result in a decrease in the amount of electromagnetic energy necessary to remove inorganic constituents from the carbonaceous solids. Thus, it may be desirable to heat the slurry to approximately the temperature at which solubilization takes place in the irradiation zone prior to subjecting the slurry to the electromagnetic energy.

In the electromagnetic irradiation zone, the combination of the acid solution and the electromagnetic radiation results in near complete dissolution of the inorganic constituents in the carbonaceous solids. Evidently, the electromagnetic energy promotes the reaction of the acid with the inorganic constituents thereby facilitating the solubilization of these constituents without destroying any of the carbonaceous material. Although it is not completely understood why the electromagnetic energy enables the acid to dissolve substantially all of the inorganic constituents, it is believed that the electromagnetic radiation serves as a source of intense energy which rapidly heats the acid solution and the internal as well as the external portions of the individual particles in the slurry. It is felt that this rapid and intense internal heating either facilitates the diffusion processes of the inorganic constituents in solution or ruptures the individual particles thereby exposing additional inorganic constituents to the reactive acid. The heat generated in the aqueous liquid itself will vary at different points around the liquid-solid interface and this may create large thermal convection currents which can agitate and sweep away the spent acid solution containing dissolved inorganic constituents from the surface layers of the carbonaceous particles thus exposing the particle surfaces to fresh acid.

Electromagnetic irradiation zone 18 will normally be equipped with conventional electromagnetic radiation generating systems which are well known to those skilled in the art. In such systems, electric line current is converted to direct current by a direct current power supply. This direct current energy is then applied to an electromagnetic radiation generator, such as a Magnetron or Klystron for generating microwaves or a radio frequency tube for generating radio waves, which converts the direct current into electromagnetic energy. The electromagnetic energy is in turn transmitted to the reaction system through a wave guide, coaxial cable or similar device. The frequency of electromagnetic radiation generated in zone 18 will normally be in the range between about 0.1 MHz and about $10^5$ MHz, preferably between about $10^2$ MHz and about $10^4$ MHz and most preferably between about 1000 MHz and about 3000 MHz. The power of the generated radiation is normally maintained at a value to prevent arcing from occurring in the irradiation zone.

Within the above-recited frequency ranges, the actual frequency used will normally be sufficiently low to provide adequate penetration of the radiation into the slurry of carbonaceous solids and acid solution as determined by the electrical conductivity and the dielectric properties of the slurry, and sufficiently high to allow the radiation to exist within the dimensions of the irradiation zone; i.e., the wave length of the electromagnetic fields must be below cut-off. If the depth of penetration is substantially less than the depth of the slurry in the irradiation zone, agitation of the slurry may be required to provide adequate exposure to the electromagnetic radiation.

The residence time of the slurry of carbonaceous solids and aqueous acid solution in electromagnetic irradiation zone 18 will normally depend upon the temperature of the feed to the zone, the size of the carbonaceous solids in the slurry and the power of the electromagnetic radiation. For a given power level, the greater the temperature of the feed slurry, the less irradiation time is necessary to solubilize the inorganic constituents in the carbonaceous solids. Similarly, the smaller the size of the individual particles of carbonaceous solids, the shorter is the irradiation time needed to solubilize and extract a substantial portion of the inorganic constituents. Normally, the power absorption will be sufficiently high to allow a radiation exposure time of less than about 3 minutes. For a power absorption of a few watts per cubic centimeter of slurry, the radiation exposure time will normally range from about 0.2 minutes to about 5 minutes and will typically be between about 2 minutes and about 3 minutes.

As stated previously, the slurry fed to electromagnetic irradiation zone 18 will normally be at ambient temperature and atmospheric pressure. As the slurry is subjected to electromagnetic radiation in zone 18, the temperature of the slurry will normally increase to be at or just below the boiling point of the aqueous acid solution. In general, the temperature of the slurry in the irradiation zone will be sufficiently high to effect rapid solubilization of the inorganic constituents in the carbonaceous solids and sufficiently low to prevent excessive evaporation of the aqueous acid solution. Normally, the temperature will range somewhere between about 95° C. and about 110° C. The pressure in the irradiation zone will normally be maintained at about atmospheric pressure. In some cases it may be desirable to preheat the slurry fed to the irradiation zone in order to decrease the size and/or power of the generator required to produce the electromagnetic energy needed in the zone to dissolve and extract the inorganic constituents from the carbonaceous solids in the presence of the aqueous acid solution. Even if this is the case, the slurry fed to the irradiation zone and the irradiation zone itself will normally be maintained at about atmospheric pressure.

The effluent exiting electromagnetic irradiation zone 18 through line 20 will normally be a slurry of carbonaceous solids depleted in inorganic mineral constituents and an aqueous acid solution containing inorganic sulfur compounds and other mineral constituents that were solubilized in the irradiation zone. This slurry is passed to centrifuge, filter or other solids-liquid separation device 22 where the aqueous acid solution containing solubilized inorganic constituents is separated from the mineral-depleted carbonaceous solids. The aqueous acid solution is removed from the centrifuge through line 24 and passed to evaporator or similar vessel 26 for recovery of the acid solution from the solubilized inorganic mineral constituents.

The mineral-depleted carbonaceous solids removed from separator 22 will contain entrained acid solution containing dissolved mineral constituents. These solids are passed through line 28 into water wash zone 30 where substantially all of the remaining acid solution is removed from the solids. The water wash zone will normally comprise a multistage countercurrent extraction system in which the solids are counter-currently contacted with water introduced through line 32. A dilute acid solution containing dissolved mineral constituents is removed from the unit through line 34, mixed with the aqueous acid solution recovered from separator 22 through line 24 and passed into evaporator 26.

The carbonaceous solids from which substantially all of the aqueous acid solution has been removed are withdrawn from water wash zone 30 through line 36. These solids will be substantially depleted of inorganc mineral constituents including inorganic sulfur compounds and are suitable for direct burning to utilize their heat content or for passage to gasification, liquefaction, pyrolysis, and similar conversion processes. The solids, however, will contain a substantial amount of moisture and may need to be dried before they are further processed. Since the solids are wet, they are suitable for transportation in a slurry pipeline to some other location where they could be dried and then processed.

The aqueous acid solutions containing dissolved inorganic constituents that are removed from separator 22 through line 24 and water wash zone 30 through line 34 are passed into evaporator or similar vessel 26. Here the combined aqueous acid solutions are heated to vaporize water and acid constituents thereby concentrating the dissolved inorganic mineral constituents. The mineral salts produced in evaporator 26 are withdrawn through line 38 and can be discarded, fed to processes in which metals are recovered from the salts or used for other purposes.

The water and acid constituents vaporized in vessel 26 are withdrawn through line 40, condensed and mixed with fresh acid introduced into line 40 through line 42. The resulting mixture is passed through line 16 into line 14 where it is combined with the carbonaceous solids exiting crusher 12. Recovery of the acid constituents that do not react with inorganic constituents of the carbonaceous solids in electromagnetic irradiation zone 18 by this method and their subsequent reuse in the irradiation zone results in a more efficient and less expensive process.

The process of the invention is particularly useful for treating coal mine tailings which are fines having a substantially greater mineral content than run-of-mine coal. Coal tailings are produced as a by-product of mining and conventional coal cleaning plants and have little or no use. Because these tailings are very fine, the amount of acid and length of electromagnetic irradiation required to remove substantially all of the mineral matter are relatively small. Moreover, since the fineness of the particles results in more efficient removal of mineral matter, the upgraded tailings have a high organic content and are suitable for further processing.

The nature and objects of the invention are further illustrated by the results of laboratory tests. The first series of tests illustrates that treatment of various types of carbonaceous solids containing inorganic constituents with an aqueous acid solution in the presence of electromagnetic energy in the microwave range will remove a substantial portion of the inorganic compounds. The second series of tests illustrates that such a treatment will remove substantially all of the inorganic sulfur from various types of coals. The third series of tests illustrates that preheating the aqueous acid solution prior to the treatment step will reduce the amount of microwave energy required to effect the removal of the inorganic constituents. The fourth series of tests illustrates that the size of the carbonaceous feed material affects the amount of inorganic constituents that can be removed.

In the first series of tests, 200 milligrams of carbonaceous solids selected from the group consisting of bituminous coal, subbituminous coal, charcoal and oil shale were mixed with 7 milliliters of concentrated acid solution. The charcoal was comprised of particles having a size less than 100 mesh on the U.S. Sieve Series Scale. The remaining samples of carbonaceous solids were comprised of particles having a size less than 300 mesh on the U.S. Sieve Series Scale. The aqueous acid solution used was a mixture of 3 milliliters hydrochloric acid, 2 milliliters nitric acid and 2 milliliters hydrofluoric acid. Prior to mixing the carbonaceous solids with the acid solution, a separate portion of each sample was ashed and analyzed to determine the amount and types of inorganic constituents present. The mixture of solids and acid, which was at room temperature, was placed in a non-metallic container inside a microwave oven where the mixture was irradiated with microwaves having a frequency of 2450 MHz for about 3 minutes. After irradiation, the non-metallic container was removed from the oven and its contents filtered to separate the solids from the liquid. The liquid was then analyzed by Inductively Coupled Plasma Emission Spectroscopy to determine the amount of each inorganic constituent that had been extracted or solubilized from the solids. The results of these tests are set forth below in Table 1.

TABLE 1

REMOVAL OF MINERAL MATTER FROM CARBONACEOUS SOLIDS

| Inorganic+ Compound | Bituminous Coal** Present* | Bituminous Coal** Removed* | Bituminous Coal** % Removed | Subbituminous Coal** Present* | Subbituminous Coal** Removed* | Subbituminous Coal** % Removed | Oil Shale*** Present* | Oil Shale*** Removed* | Oil Shale*** % Removed | Charcoal Present* | Charcoal Removed* | Charcoal % Removed |
|---|---|---|---|---|---|---|---|---|---|---|---|---|
| $Al_2O_3$ | 3.36 | 3.14 | 93 | 0.61 | 0.49 | 81 | 6.0 | 6.3 | 100 | 0.38 | 0.43 | 100 |
| CaO | 0.57 | 0.62 | 100 | 0.75 | 0.71 | 95 | 17.2 | 13.8 | 80 | 0.12 | 0.14 | 100 |
| $Fe_2O_3$ | 1.24 | 1.09 | 88 | 0.34 | 0.19 | 56 | 2.6 | 2.5 | 95 | 0.26 | 0.23 | 88 |
| $K_2O$ | 0.35 | 0.30 | 86 | 0.01 | 0.01 | 100 | 1.4 | 1.1 | 82 | 0.22 | 0.22 | 100 |
| MgO | 0.27 | 0.17 | 63 | 0.17 | 0.10 | 59 | 5.1 | 4.7 | 93 | 0.10 | 0.11 | 100 |
| $SiO_2$ | 7.23 | 5.73 | 79 | 1.11 | 1.39 | 100 | 25.9 | 23.1 | 89 | 2.25 | 1.71 | 76 |
| $Na_2O$ | — | — | — | — | — | — | 1.9 | 1.8 | 94 | — | — | — |
| $TiO_2$ | — | — | — | — | — | — | 0.22 | 0.21 | 93 | — | — | — |
| $P_2O_5$ | — | — | — | — | — | — | 0.32 | 0.28 | 88 | — | — | — |
| Trace Compounds | 0.19 | 0.13 | 69 | 0.28 | 0.24 | 86 | — | — | — | 0.06 | 0.06 | 100 |

*The numbers in these columns represent the percent of the inorganic compound based on the weight of the carbonaceous solids
**National Bureau of Standards coals
***Green River, Colorado shale
+Calculated as the oxide It can be seen from Table 1 that the treatment of bituminous coals, subbituminous coals, oil shale and charcoal with an aqueous acid solution in the presence of microwave energy results in the substantial removal of the various species of mineral matter.

The second series of tests was conducted in the same manner as discussed in relation to the first series of tests except that various types of coal only were used as the carbonaceous solids. A portion of each coal was analyzed by conventional methods for total sulfur and for inorganic sulfur prior to treatment with the aqueous acid and microwave energy. The liquid recovered after the treatment was analyzed by X-ray fluorescence for sulfur. Prior experiments in which model compounds were treated with acid and microwave energy indicated that organic sulfur is not removed by this treatment procedure. Thus all the sulfur found in the liquid was assumed to be inorganic sulfur. The results of these tests are set forth below in Table II.

TABLE II

DESULFURIZATION OF COALS

| Coal | Total Sulfur Present (Wt. %) | Inorganic Sulfur Present (Wt. %) | Sulfur in Soln. (Wt. %)* | % Inorganic Sulfur Removed* |
|---|---|---|---|---|
| Illinois No. 6 | 4.16 | 1.75 | 1.81 | 100 |
| Pennsylvania | 1.64 | 0.87 | 0.86 | 99 |
| Appalachian | 6.16 | 5.05 | 5.00 | 99 |
| Wyodak | 0.72 | 0.54 | 0.50 | 93 |

*All sulfur in solution assumed to be inorganic sulfur based on prior experiments.

As can be seen from Table II, treatment of coals with aqueous acid and microwave energy results in the removal of substantially all of the inorganic sulfur.

The third series of tests was conducted in the same general manner as discussed in relation to the first two series of tests except that the aqueous acid solution was preheated to a temperature of about 95° C. before it was mixed with the carbonaceous solids, and the time of irradiation in the microwave oven was ten seconds instead of three minutes. The results of these tests are set forth in Table III below.

TABLE III

EFFECT OF PREHEATING ON REMOVAL OF MINERAL MATTER

| Inorganic+ Compound | Coal* Wt. % Present | Coal* % Removed | Oil Shale** Wt. % Present | Oil Shale** % Removed |
|---|---|---|---|---|
| $Al_2O_3$ | 1.43 | 93 | 4.79 | 95 |
| CaO | 1.96 | 67 | 12.30 | 100 |
| $Fe_2O_3$ | 0.62 | 83 | 2.16 | 98 |
| $K_2O$ | 0.04 | 87 | 1.10 | 90 |
| MgO | 0.38 | 79 | 4.00 | 99 |
| $SiO_2$ | 2.92 | 47 | 18.60 | 83 |
| $Na_2O$ | 0.12 | 100 | 1.61 | 100 |
| $P_2O_5$ | 0.03 | 100 | 0.24 | 100 |

*Wyodak Coal
**Green River, Colorado Shale
+Calculated as the oxide

The data in Table III compare favorably with the data in Table I and indicate that similar amounts of various inorganic constituents can be removed from carbonaceous solids utilizing a much shorter microwave irradiation time if the aqueous acid solution is preheated prior to subjecting the mixture of solids and acid to microwave energy. Specifically, the data show that similar quantitative removals can be obtained by preheating the acid solution and decreasing the time of microwave exposure from three minutes to ten seconds. This observed phenomenon means that it may be possible to reduce power requirements and therefore costs of operating the process without significantly affecting the end result.

In the fourth series of tests Illinois No. 6 coal was divided into five different size fractions. Each size fraction was then treated in a manner similar to that described with respect to the first series of tests. The results of these tests are set forth in Table IV below.

TABLE IV

EFFECT OF SIZE ON REMOVAL OF MINERAL MATTER

| Inorganic+ Compound | Amount Present (Wt. %) | Percent Removed At These Sizes −8 Mesh | −20 Mesh | −40 Mesh | −100 Mesh | −200 Mesh |
|---|---|---|---|---|---|---|
| $Al_2O_3$ | 3.55 | 46 | 46 | 56 | 72 | 91 |
| CaO | 1.75 | 7 | 14 | 31 | 64 | 100 |
| $Fe_2O_3$ | 5.10 | 21 | 27 | 45 | 67 | 87 |
| $K_2O$ | 0.45 | 40 | 40 | 48 | 67 | 87 |
| $Na_2O$ | 0.22 | 19 | 22 | 35 | 58 | 86 |

TABLE IV-continued

| EFFECT OF SIZE ON REMOVAL OF MINERAL MATTER | | | | | | |
|---|---|---|---|---|---|---|
| | Amount | Percent Removed At These Sizes | | | | |
| Inorganic+ Compound | Present (Wt. %) | −8 Mesh | −20 Mesh | −40 Mesh | −100 Mesh | −200 Mesh |
| $SiO_2$ | 7.96 | 32 | 30 | 28 | 47 | 100 |
| Trace Compounds | 0.23 | 40 | 49 | 52 | 65 | 82 |

+Calculated as the oxide

The data in Table IV clearly indicate that the amount of mineral matter removed from coal by treatment with aqueous acid solution and microwave energy can be increased by decreasing the particle size of the coal. In determining the optimum particle size, the cost of crushing the coal to a fine size must be balanced against the amount of mineral matter that is removed in the microwave irradiation treatment step.

It will be apparent from the foregoing that the invention provides a process which is effective in removing large quantities of inorganic sulfur and other inorganic constituents from coal, oil shale, and similar carbonaceous solids at mild temperatures and pressures. Since the process of the invention is effective in removing both sulfur constituents and other inorganic constituents, it appears to have many advantages over chemical processes proposed in the past which are effective in removing only sulfur compounds.

We claim:

1. A process for the beneficiation of carbonaceous solids containing inorganic, ash-forming constituents including silica, alumina and metal-containing compounds which comprises:

(a) mixing said carbonaceous solids with an aqueous inorganic acid to form a slurry;

(b) treating said slurry with electromagnetic radiation having a frequency between about 0.10 MHz and about $10^5$ MHz in a treatment zone, whereby said inorganic, ash-forming constituents including silica, alumina and metal-containing compounds reacting with said inorganic acid to form soluble compounds which dissolve in the aqueous portion of said slurry and wherein the power of said electromagnetic radiation is such that no arcing occurs in said treatment zone and substantially none of the carbonaceous material in said carbonaceous solids is destroyed; and (c) recovering beneficiated carbonaceous solids depleted in said ash-forming constituents including silica, alumina and metal-containing compounds from said treatment zone.

2. A process as defined by claim 1 wherein said carbonaceous solids comprise coal.

3. A process as defined by claim 1 wherein said carbonaceous solids comprise oil shale.

4. A process as defined by claim 1 wherein said carbonaceous solids comprise liquefaction bottoms.

5. A process as defined by claim 1 wherein said carbonaceous solids are comprised of particles ranging in size below a value in the range between about 8 mesh and about 200 mesh on the U.S. Sieve Series Scale.

6. A process as defined by claim 1 wherein said aqueous inorganic acid is selected from the group consisting of nitric acid, hydrochloric acid, sulfuric acid, hydrofluoric acid and mixtures thereof.

7. A process as defined by claim 1 wherein said aqueous inorganic acid comprises a mixture of hydrochloric acid, nitric acid and hydrofluoric acid.

8. A process as defined by claim 1 wherein said slurry is preheated prior to passing said slurry into said treatment zone.

9. A process as defined by claim 1 wherein said slurry is passed at ambient conditions into said treatment zone.

10. A process as defined by claim 1 wherein said electromagnetic radiation comprises radio waves having a frequency between about $10^2$ MHz and about $10^3$ MHz or microwaves having a frequency between about $10^3$ MHz and about $10^4$ MHz.

11. A process as defined by claim 10 wherein said electromagnetic radiation comprises microwaves having a frequency between about 1000 MHz and about 3000 MHz.

* * * * *